US011627792B2

(12) United States Patent
Berhault et al.

(10) Patent No.: US 11,627,792 B2
(45) Date of Patent: Apr. 18, 2023

(54) APPLICATOR FOR APPLYING A PRODUCT TO THE EYELASHES

(71) Applicant: L'OREAL, Paris (FR)

(72) Inventors: Alain Berhault, Clichy (FR); Eric Caulier, Clichy (FR)

(73) Assignee: L'OREAL, Paris (FR)

( * ) Notice: Subject to any disclaimer, the term of this patent is extended or adjusted under 35 U.S.C. 154(b) by 483 days.

(21) Appl. No.: 15/526,841

(22) PCT Filed: Nov. 13, 2015

(86) PCT No.: PCT/EP2015/076536
§ 371 (c)(1),
(2) Date: May 15, 2017

(87) PCT Pub. No.: WO2016/075282
PCT Pub. Date: May 19, 2016

(65) Prior Publication Data

US 2017/0311700 A1 Nov. 2, 2017

(30) Foreign Application Priority Data

Nov. 14, 2014 (FR) ..... 1461012

(51) Int. Cl.
*A45D 40/26* (2006.01)
*A46B 9/02* (2006.01)
(Continued)

(52) U.S. Cl.
CPC ..... *A45D 40/267* (2013.01); *A46B 3/005* (2013.01); *A46B 3/18* (2013.01); *A46B 9/021* (2013.01);
(Continued)

(58) Field of Classification Search
CPC .. A45D 34/042; A45D 34/043; A45D 34/045; A45D 34/046; A45D 40/262;
(Continued)

(56) References Cited

U.S. PATENT DOCUMENTS 5,063,947 A * 11/1991 Gueret ..... A46D 1/0292 132/218
6,408,857 B1 * 6/2002 Neuner ..... A45D 40/265 132/218
(Continued)

FOREIGN PATENT DOCUMENTS

EP 1 611 817 A1 1/2006
EP 2196106 A1 * 6/2010 ..... A45D 40/265
(Continued)

OTHER PUBLICATIONS

Aug. 6, 2018 Japanese Office Action issued in Japanese Application No. 2017-525977.
(Continued)

*Primary Examiner* — Jacqueline T Johanas
*Assistant Examiner* — Sarah Woodhouse
(74) *Attorney, Agent, or Firm* — Oliff PLC

(57) ABSTRACT

The present invention relates to an applicator for applying a cosmetic product to the eyelashes and/or eyebrows, having an applicator member with a core made of thermoplastic material, spikes moulded with the core, of which at least some are multiple, the multiple spikes having at least two branches extending in divergent directions away from the core, these branches connecting to one and the same base or having bases contiguous or close to each other, and a support having two metal branches twisted around the core.

10 Claims, 2 Drawing Sheets

Figure 1:
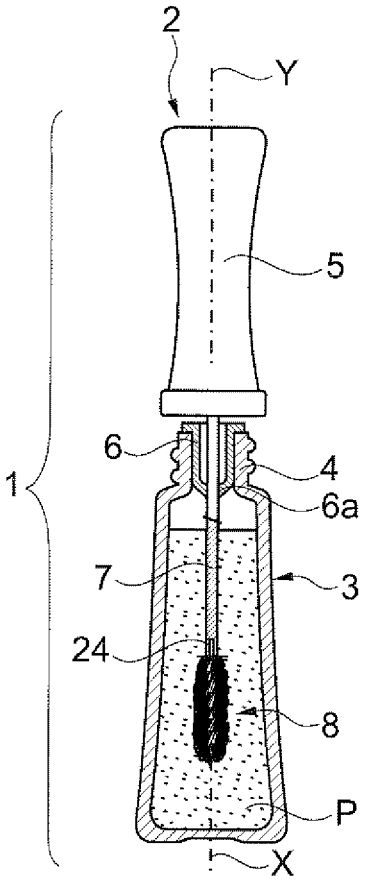

(51) Int. Cl.
*A46B 3/18* (2006.01)
*A46B 3/00* (2006.01)

(52) U.S. Cl.
CPC ..... *A46B 9/028* (2013.01); *A46B 2200/1053* (2013.01)

(58) Field of Classification Search
CPC .. A45D 40/264; A45D 40/265; A45D 40/267; A46B 3/18; A46B 9/021; A46B 9/025; A46B 9/028; A46B 2200/1046; A46B 2200/1053; A46B 2200/106
USPC ..... 132/216, 218, 313, 317
See application file for complete search history.

(56) References Cited

U.S. PATENT DOCUMENTS

| | | | | |
|---|---|---|---|---|
| 6,450,177 | B1 * | 9/2002 | Christoforu | A45D 40/265 132/218 |
| 2003/0213498 | A1 * | 11/2003 | Gueret | A46B 9/028 132/218 |
| 2006/0002758 | A1 | 1/2006 | Gueret | |
| 2006/0279181 | A1 * | 12/2006 | Gueret | A45D 40/262 312/218 |
| 2008/0245382 | A1 | 10/2008 | Marciniak-Davoult et al. | |
| 2009/0193602 | A1 * | 8/2009 | Dumler | A46B 3/005 15/160 |
| 2009/0320872 | A1 * | 12/2009 | Vandromme | A45D 40/262 132/218 |
| 2010/0089415 | A1 * | 4/2010 | Vandromme | A45D 40/262 132/218 |
| 2010/0175708 | A1 * | 7/2010 | Kim | A45D 40/262 132/218 |
| 2012/0148328 | A1 | 6/2012 | Jollet | |
| 2013/0036565 | A1 * | 2/2013 | Gueret | A46B 3/005 15/160 |
| 2013/0104925 | A1 * | 5/2013 | Caulier | A45D 40/262 132/218 |
| 2013/0195539 | A1 | 8/2013 | Fontaine | |
| 2014/0003857 | A1 * | 1/2014 | Gueret | A45D 40/265 401/129 |

FOREIGN PATENT DOCUMENTS

| | | | | |
|---|---|---|---|---|
| EP | 2196106 | A1 | 6/2010 | |
| FR | 2900318 | A1 | 11/2007 | |
| FR | 2913572 | A1 | 9/2008 | |
| FR | 2936691 | A1 | 4/2010 | |
| FR | 2958130 | A1 | 10/2011 | |
| FR | 2958130 | A1 * | 10/2011 | A45D 40/262 |
| FR | 2958134 | A1 | 10/2011 | |
| FR | 2962888 | A1 | 1/2012 | |
| JP | 2003-079427 | A | 3/2003 | |
| JP | 2003079427 | † | 3/2003 | |
| WO | 2006/090343 | A1 | 8/2006 | |
| WO | 2008/091128 | A1 | 7/2008 | |
| WO | 2011/077318 | A2 | 6/2011 | |
| WO | 2013/003442 | A2 | 1/2013 | |

OTHER PUBLICATIONS

Mar. 14, 2017 Third Party Observation issued in International Patent Application No. PCT/EP2015/076536.
Jan. 27, 2016 International Search Report issued in International Patent Application No. PCT/EP2015/076536.
Jan. 27, 2016 Written Opinion issued in International Patent Application No. PCT/EP2015/076536.

* cited by examiner
† cited by third party

APPLICATOR FOR APPLYING A PRODUCT TO THE EYELASHES

The present invention relates to applicators for applying a cosmetic, makeup or care product to the eyelashes or eyebrows, and to packaging and application devices having such applicators.

Applicators are known that have an applicator member composed of a core moulded with spikes made of a thermoplastic material. A disadvantage of these applicators is linked to the fact that the applicator member must be able to be demoulded, which places limitations on the orientation that the spikes can be given.

Brushes are also known that have a twisted core with two metal branches which between them enclose hairs.

Applicators have also been proposed that are referred to as hybrid applicators and that have a core of thermoplastic material supporting spikes, and metal branches which enclose the core and which are twisted thereon, imparting a torsion to the core and causing the spikes to form helical layers. The application US 2012/0148328 A1 discloses such an applicator.

There is a need to further improve the hybrid applicators having a core of thermoplastic material, spikes moulded with the core, and a support having two metal branches twisted on the core in order to cause the latter to turn about its longitudinal axis such that the spikes follow a helical trajectory.

The invention thus relates to an applicator for applying a cosmetic product to the eyelashes and/or eyebrows, having an applicator member with a core made of thermoplastic material, spikes moulded with the core, of which at least some are multiple, and a support having two metal branches twisted around the core.

The presence of the multiple spikes permits a denser distribution of the free ends of the spikes, more akin to the distribution of the hairs on conventional brushes with a twisted core, and in particular permits a good separation of the eyelashes during the application.

The multiple spikes can be double spikes.

"Multiple spikes" are spikes having at least two branches extending in divergent directions away from the core, these branches connecting, in particular on the core, to one and the same base or having bases contiguous or close to each other.

"Bases close to each other" are bases with a distance between them that is less than their greatest dimension, measured perpendicularly with respect to the axis of elongation of the corresponding branch.

A "spike" is an individual projecting element.

The branches of a multiple spike can occupy the same axial position along the longitudinal axis of the core. The longitudinal axes of the branches of the multiple spike can be contained within one and the same plane, perpendicular to the longitudinal axis of the core.

In the case of a double spike, the two branches of the spike can be symmetrical to each other with respect to a median plane of symmetry, containing the longitudinal axis of the core, when this is rectilinear.

The double spikes can each have two branches, of which the bases are contiguous or less than 0.8 mm from each other.

The divergent branches of the double spike can form between them an angle of between 45 and 75°, preferably between 55 and 65°.

The applicator can have at least one row of multiple spikes, preferably double spikes, which row extends axially for example along substantially the entire length of the core.

The applicator can in particular have two rows of multiple spikes, preferably double spikes, opposite each other. These two rows can be the only rows of multiple spikes on the applicator.

The applicator can have at least one row of single spikes, preferably only two rows of single spikes, located opposite each other between the rows of multiple spikes.

The single spikes can be rectilinear and extend radially from the longitudinal axis of the core.

The applicator can have only four rows of spikes, of which two rows of single spikes and two rows of multiple spikes, preferably double spikes.

The spikes, whether single or multiple, can be arranged in rows, joining each other on ribs of the core which between them define longitudinal grooves in which the metal branches of the support extend.

The core can turn by more than one revolution on itself about its longitudinal axis, from one end to the other of the applicator member, under the effect of the twist induced by the branches of the support. The thermoplastic material of the core is advantageously an elastomer, so as to permit such a rotation without damaging the core.

The height of the ribs of the core can be at least 0.8 mm.

The applicator advantageously has a stem in which the support is inserted.

The fixing of the support can be effected analogously to the fixing of the twisted cores of conventional mascara brushes, by thermal insertion of the core in a recess of the stem.

A further subject of the invention is a device for packaging and application having an applicator according to the invention, as defined above, and a container containing the product to be applied.

A further subject of the invention is a method for producing an applicator as defined above, comprising the steps of moulding the core and the spikes in a thermoplastic material and twisting two branches of a metal wire on the core in order to cause the core to deform by torsion about its longitudinal axis.

A further subject of the invention is a method for making up the eyelashes and/or eyebrows, in which an applicator according to the invention is used to apply the makeup product.

Figure 2:
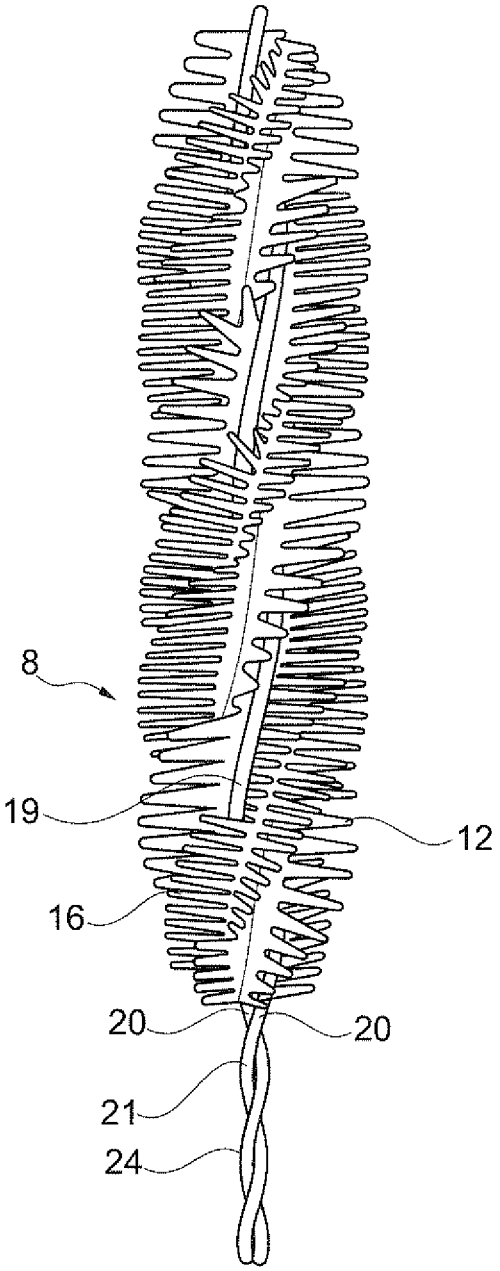
Figure 3:
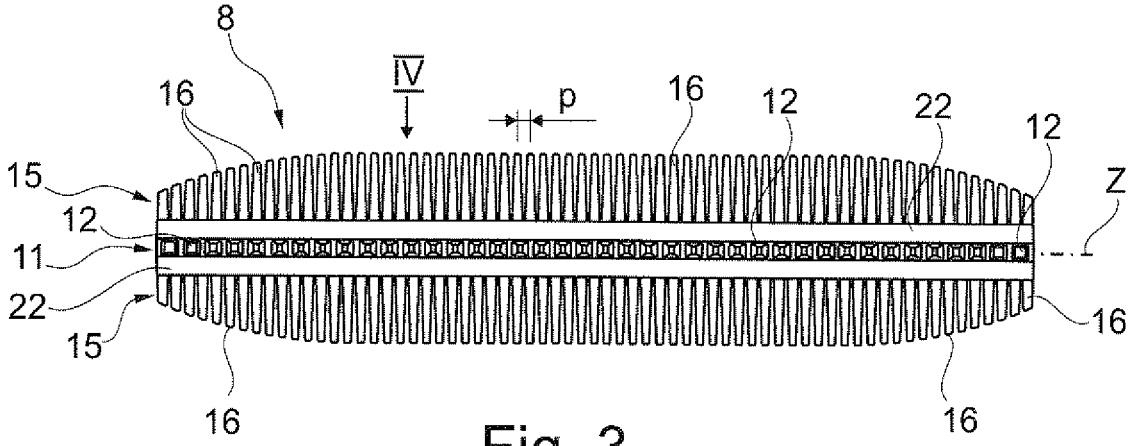
Figure 4:
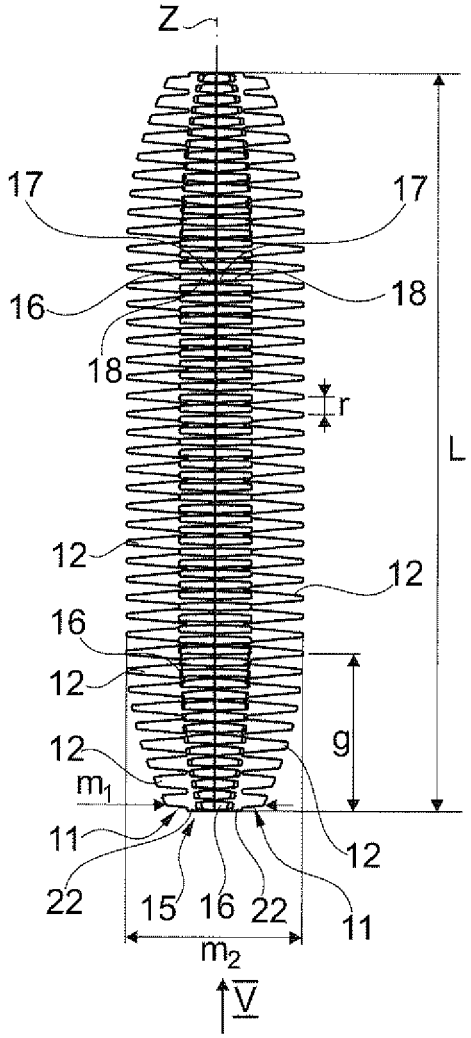
Figure 5:
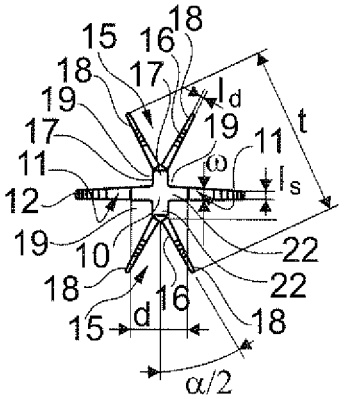

The invention may be better understood from reading the following detailed description of a non-limiting implementation example thereof, and from examining the attached drawing, in which:

FIG. 1 shows schematically, in longitudinal section, a packaging and application device according to the invention, FIG. 2 shows just the applicator member of the applicator from FIG. 1, FIG. 3 shows just the thermoplastic part of the applicator member, before the support is placed thereon, FIG. 4 is a front view along the arrow IV in FIG. 3, and FIG. 5 is a view along the arrow V in FIG. 4.

FIG. 1 shows a packaging and application device 1 produced in accordance with the invention, having an applicator 2 and an associated container 3 containing a product P to be applied to the eyelashes and/or eyebrows, for example mascara or a care product.

The container 3 has, in the example in question, a threaded neck 4 and the applicator 2 has a closure cap 5 designed to be fixed on the neck 4 so as to close the container 3 in a sealed manner when it is not in use, the closure cap 5 also forming a gripping member for the applicator 2.

The applicator 2 has a stem 7 of longitudinal axis Y, which is attached at its upper end to the closure cap 5 and at its lower end to an applicator member 8 according to the invention. The latter has a thermoplastic part, shown on its own in FIGS. 3 to 5, and a support 21 having two metal branches 20, visible in FIG. 2, which are twisted on the thermoplastic part and between them to form a tail 24 serving to fix the applicator member 8 to the stem 7.

The thermoplastic part has a core 10 and single spikes 12 and double spikes 16 that extend from the core 10 and all around the latter.

The container 3 has a wiping member 6, for example inserted into the neck 4.

This wiping member 6, which may be any wiping member, and which is made of elastomer for instance, has, in the example in question, a lip designed to wipe the stem 7 and the applicator member 8 when the applicator 2 is withdrawn from the container 3. This wiping lip defines a wiping orifice 6*a* having a diameter adapted to that of the stem 7.

The wiping orifice 6*a* can be of circular shape, possibly with slits.

The diameter of the wiping orifice 6*a* is, for example, between 2.5 and 6 mm.

The wiping lip 6 may optionally have undulations, allowing the wiping orifice 6*a* to widen more easily when the applicator member 8 passes through.

In the example illustrated, the stem 7 has a circular cross section, but, if the stem 7 has some other section, this does not depart from the scope of the present invention, it then being possible to fix the cap 5 on the container 3 in some other way than by screwing, if necessary.

Preferably, and as in the example in question, the longitudinal axis Y of the stem 7 is rectilinear and coincident with the longitudinal axis of the container 3 when the applicator 2 is in place thereon, but, if the stem 7 is not rectilinear, forming for example an elbow, this does not depart from the scope of the present invention.

If need be, the stem 7 may have an annular narrowing on its portion that is positioned opposite the wiping lip, so as not to mechanically stress the latter unduly during storage.

The stein 7, to which the applicator member 8 is fixed, may also be at least partially, and in particular completely, flexible, in particular in the vicinity of the applicator member.

In order to mould the thermoplastic part of the applicator member 8, use can be made of any thermoplastic material which is or is not relatively rigid, for example SEBS, a silicone, latex, a material having improved slip, butyl, EPDM, a nitrile, a thermoplastic elastomer, a polyester elastomer, a polyamide elastomer, a polyethylene elastomer or a vinyl elastomer, a polyolefin such as PE or PP, PVC, EVA, PS, SEBS, SIS, PET, POM, PU, SAM, PA or PMMA. It is possible in particular to use the materials known under the trade names Teflon®, Elytrelt, Cariflex®, Santoprene®, Pebax® or Pollobas®, this list not being limiting.

Referring to FIGS. 2 to 5, it will be seen that the core 10 has a cruciform cross section with four ribs 22 which are arranged in opposite pairs and join at the centre of the core 10.

In the example in question, the core 10 carries two rows 11 of single spikes 12, these rows being diametrically opposite, and two other rows 15 of double spikes 16. Each double spike 16 has two branches 18 which diverge from the longitudinal axis Z of the core 10 by an angle $\alpha$, with $\alpha/2$ which is, for example, equal to 30° as illustrated. The branches 18 of one and the same double spike 16 join at the summit of the corresponding rib 22 of the core 10. The bases 17 of these branches 18 occupy the same axial position on the longitudinal axis Z of the core, since they are arranged side by side on the rib 22 and are contiguous.

The core 10 can have an axial symmetry about the axis Z, for example with a distance d, between the summits of the opposite ribs 22, of between 2 and 3 mm, for example of the order of 2.3 mm.

The width w of a rib 22 of the core 10 is, for example, between 0.5 and 0.8 mm, being for example of the order of 0.6 mm.

La distance t between the ends of the diametrically opposite branches 18 of two double spikes 16 belonging respectively to the two opposite rows 15 of double spikes is preferably between 5 and 10 mm, for example of the order of 7 mm.

When the applicator member 8 is observed along its longitudinal axis Z, the width $l_s$ of a single spike 12 at its free end is, for example, between 0.25 and 0.35 mm, especially of the order of 0.3 mm, and the width $l_d$ of a double spike 16 is, for example, between 0.1 and 0.2 mm, being for example of the order of 0.15 mm.

The distance p between the axes of two consecutive double spikes 16 within one row 15 of double spikes is preferably between 0.3 and 1 mm, for example 0.45 mm.

The distance r between the axes of two consecutive single spikes 12 is preferably between 0.5 and 1.6 mm, for example approximately 0.75 mm.

The height of the spikes 12 and 16, whether single or double, may decrease towards the free ends of the core 10.

The diameter of the circle circumscribed by the opposite single spikes changes, for example, from $m_1$ to $m_2$, with $m_2>m_1$, as illustrated in FIG. 4, for example with $m_1$ equal to 4 mm and $m_2$ equal to 7 mm. The diameter $m_2$ is reached, for example, at a distance g, from the end of the core, of between 6 and 7 mm.

That part of the applicator member 8 made of plastic can have a shape generally symmetrical with respect to a median plane intersecting same at the halfway length and perpendicular to the axis Z.

The total length L of the plastic part of the applicator member 8 is preferably between 25 and 35 mm, for example equal to approximately 30 mm.

To produce the applicator member 8, the part thereof made of plastic is first of all moulded in the configuration illustrated in FIGS. 3 to 5.

The support 21 is then put in place. The two branches 20 are then given the form of a U-shaped pin and engage respectively in the diametrically opposite grooves 19 formed between the ribs 22. By twisting the branches 22, the core 10 is then subjected to torsion over more than one revolution about the longitudinal axis Z. The shape shown in FIG. 2 is obtained, with the rows of spikes that each follow a substantially helical trajectory. By virtue of the branching of the double spikes 16, spikes that are directed with orientations very particularly suitable for making up the eyelashes and/or eyebrows are arranged on the applicator member.

In order to use the device 1, the user unscrews the closure cap 5 and withdraws the applicator member 8 from the container 3.

Once the applicator member 8 has passed through the wiping member 6, a particular quantity of product P remains in the grooves 19 formed on the core between the ribs, creating reservoirs of product along the entire length of the core 10 and on all sides, making it possible to load the eyelashes and/or eyebrows with product P in a satisfactory manner.

Of course, the invention is not limited to the exemplary embodiment which has just been described.

The applicator member 8 may be able to vibrate, that is to say it is possible to apply vibrations thereto during application, combing or picking-up of the product P, for example as described in the application WO 2006/090343.

In a further variant, the applicator member 8 may be able to rotate, that is to say it may be made to carry out a rotational movement about the longitudinal axis Z of the core 10, for example during application, combing or picking-up of the product P.

In a further variant, the applicator member 8 may be heated, that is to say have a heating element for heating the eyelashes and/or eyebrows, and/or the spikes 12 and 16 and/or the core 10 of the applicator member 8.

It is also possible for the applicator member 8 to be able to vibrate, to be able to rotate and to be heated, or only to be able to vibrate and to rotate, or only to be able to vibrate and to be heated, or only to be able to rotate and to be heated, or only to be able to vibrate or only to be able to rotate or only to be able to be heated.

The applicator member 8 may comprise any bactericidal agent such as silver salts, copper salts, preservatives and at least one preservative for the product P.

In addition, the core 10 and/or the spikes 12 and 16 can have particles, for example a charge, in particular a magnetic or bacteriostatic compound or a humidity absorber, or a compound intended to create roughness at the surface of the spikes 12 and 16 or to promote the sliding of the eyelashes and/or eyebrows thereon. One at least of the core 10 or a spike 12 or 16 can be flocked, receive any heat treatment or mechanical treatment, and/or have particles, for example a charge, in order in particular to improve the sliding of the applicator member on the eyelashes and/or eyebrows.

The expression "having a" should be understood as being synonymous with "having at least one", and "between" is understood as including the limits, unless specified to the contrary.

The invention claimed is:

1. Applicator for applying a cosmetic product to the eyelashes and/or eyebrows, having an applicator member with:

a core made of thermoplastic material, the core having ribs extending continuously along the length of the core and defining grooves between adjacent ribs, a support having two metal branches extending each in one of the grooves, the two metal branches being twisted around the core after being positioned in the grooves, two rows of double spikes, moulded with the core before the two metal branches are twisted around the core, the double spikes of each of the two rows extending from a respective corresponding rib of the core, the two ribs from which the two rows of a plurality of double spikes extend being opposite from each other relative to a longitudinal axis of the core, the double spikes having at least two branches joining at their bases at a summit of the corresponding rib and extending in divergent directions away from said summit, for each double spike, the bases of said branches occupying on the corresponding rib a same axial position on the longitudinal axis of the core and the longitudinal axes of the two branches being contained within a same plane, perpendicular to the longitudinal axis of the corresponding rib, the longitudinal axis of the ribs forming each a helical trajectory after twisting, the said same plane for the two branches of each double spike being perpendicular to the longitudinal axis of the core before the two metal branches being twisted around the core and being inclined relative to the longitudinal axis of the core after the two metal branches being twisted around the core because of a change of orientation of the longitudinal axis of the ribs that changes from rectilinear longitudinal axis along the longitudinal axis of the core to the helical trajectory when the two metal branches are twisted around the core, at least one row of single spikes, moulded with the core before the two metal branches are twisted around the core, extending between the two rows of double spikes, the orientation of the single spikes being perpendicular to the longitudinal axis of the core before and after the two metal branches are twisted around the core.

2. Applicator according to claim 1, the single spikes being rectilinear and extending radially from the longitudinal axis of the core.

3. Applicator according to claim 1, having only four rows of spikes, among which two rows are of single spikes and two rows are of double spikes.

4. Applicator according to claim 1, the branches of the double spikes forming between them an angle of between 45 and 75°.

5. Applicator according to claim 4, wherein the angle is between 55 and 65°.

6. Applicator according to claim 1, the core turning by more than one revolution on itself about its longitudinal axis, from one end to the other of the applicator member, under the effect of the twist induced by the branches of the support.

7. Applicator according to claim 1, the core defining ribs on which the spikes are connected, these ribs having a height of at least 0.8 mm.

8. Applicator according to claim 1, having a stem in which the support is inserted.

9. Device for packaging and application having an applicator according to claim 1 and a container containing the product to be applied.

10. Method for producing an applicator according to claim 1, comprising the steps of moulding the core and the spikes in a thermoplastic material and twisting two branches of a metal wire on the core in order to cause the latter to deform by torsion about its longitudinal axis.

* * * * *